US010345065B2

(12) United States Patent
Roe

(10) Patent No.: US 10,345,065 B2
(45) Date of Patent: Jul. 9, 2019

(54) RIFLE MAGAZINE LOADER APPARATUS

(71) Applicant: Richard Darin Roe, Midland, TX (US)

(72) Inventor: Richard Darin Roe, Midland, TX (US)

( * ) Notice: Subject to any disclaimer, the term of this patent is extended or adjusted under 35 U.S.C. 154(b) by 0 days.

(21) Appl. No.: 16/128,132

(22) Filed: Sep. 11, 2018

(65) Prior Publication Data

US 2019/0017763 A1 Jan. 17, 2019

Related U.S. Application Data

(63) Continuation-in-part of application No. 15/619,234, filed on Jun. 9, 2017.

(60) Provisional application No. 62/489,809, filed on Apr. 25, 2017.

(51) Int. Cl.
*F41A 9/83* (2006.01)

(52) U.S. Cl.
CPC ..... *F41A 9/83* (2013.01)

(58) Field of Classification Search
CPC ..... F41A 9/24; F41A 9/25; F41A 9/82; F41A 9/83; F41A 9/84
See application file for complete search history.

(56) References Cited

U.S. PATENT DOCUMENTS 452,447 A * 5/1891 Bruce ..... F41A 9/84 42/88
1,295,038 A * 2/1919 Johnson et al. ..... F41A 9/83 86/47
2,402,195 A * 6/1946 Woodberry ..... F42B 39/10 42/88
2,403,012 A * 7/1946 McPheters ..... F41A 9/83 42/87
2,887,811 A * 5/1959 Johnson, Jr. ..... F41A 9/84 42/87
2,894,350 A * 7/1959 Janson ..... F41A 9/84 42/50
4,706,402 A * 11/1987 Csongor ..... F41A 9/84 42/87
5,669,171 A * 9/1997 Sally ..... F41A 9/66 42/60
6,754,987 B1 * 6/2004 Cheng ..... F41A 9/83 42/87
7,059,077 B2 * 6/2006 Tal ..... F41A 9/83 42/88
9,574,836 B1 * 2/2017 Cauley, Jr. ..... F41A 9/83
10,126,077 B1 * 11/2018 Glover ..... F41A 9/83
10,139,176 B1 * 11/2018 Witecha ..... F41A 9/83
2013/0067788 A1 * 3/2013 Gray ..... F41A 9/84 42/88
2014/0223792 A1 * 8/2014 Socivoi ..... F41A 9/82 42/50
2014/0298704 A1 * 10/2014 Niccum ..... F41A 9/83 42/87

(Continued)

*Primary Examiner* — Derrick R Morgan
(74) *Attorney, Agent, or Firm* — Eldredge Law Firm, LLC; Richard Eldredge; Beth Felix

(57) ABSTRACT

A magazine loader apparatus includes an elongated body; a slider device secured within an interior of the elongated body; a first cradle to hold a cartridges and to slidingly engage with the slider device within the interior of the elongated body; the first cradle is to align with a magazine; and applying force to the first cradle via the magazine causes the first cradle to slide away from the magazine, thereby releasing the cartridges into the magazine.

3 Claims, 5 Drawing Sheets

(56) References Cited

U.S. PATENT DOCUMENTS

| | | | | |
|---|---|---|---|---|
| 2016/0033220 | A1* | 2/2016 | Grandy | F41A 9/63<br>42/49.01 |
| 2017/0211902 | A1* | 7/2017 | Mills | F41A 9/83 |
| 2018/0094888 | A1* | 4/2018 | Hefer | F42B 39/26 |
| 2018/0292152 | A1* | 10/2018 | Wilkinson | F41A 9/84 |
| 2019/0017761 | A1* | 1/2019 | Henderson | F41A 9/83 |

* cited by examiner

RIFLE MAGAZINE LOADER APPARATUS

BACKGROUND

1. Field of the Invention

The present invention relates generally to ammunition handling systems, and more specifically, to an apparatus to facilitate the loading of a rifle magazine.

2. Description of Related Art

Ammunition handling systems are well known in the art and are effective means to store, transport, and use ammunition for firearms. For example, FIG. 1 depicts a conventional rifle magazine 101 having a tube 103 that houses a spring 105 attached to a follower 107. During use, cartridges 109 are place in the tube 103 by depressing the follower 107.

One of the problems commonly associated with magazine 101 is its limited efficiency. For example, loading the cartridges 109 in the magazine 101 requires the use of both hands to perform this time consuming and tedious task. To load cartridges 109 in the magazine commonly requires multiple attempts due to the round shape of the cartridges that causes the one being loaded to slip off the top of the one previously loaded. This repeated action can cause fatigue and injury. Additionally, the cartridges 109 must be stored prior to being placed in the magazine 101 resulting in packaging waste.

Accordingly, although great strides have been made in the area of ammunition handling systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
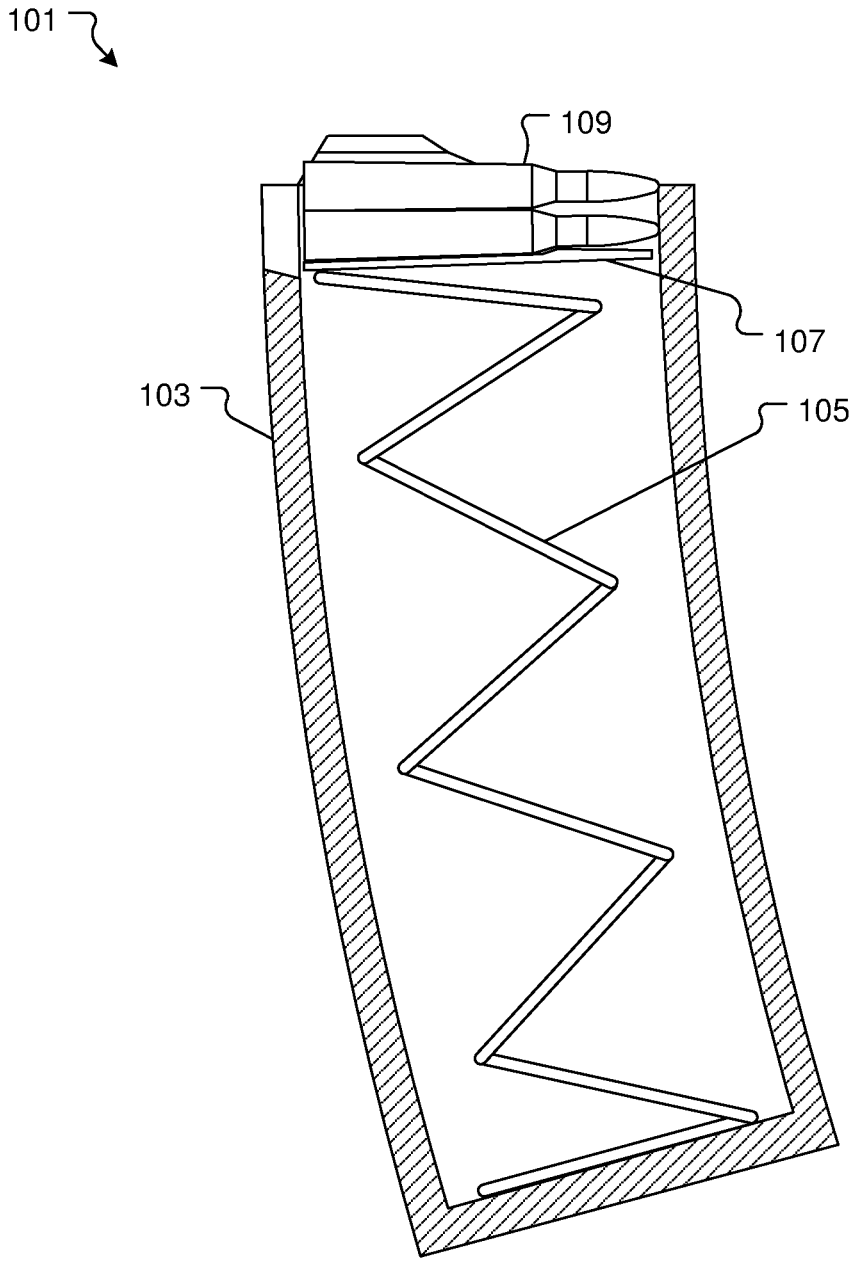
FIG. 1 (Prior Art)
FIG. 1 is a cross-sectional side view of a common rifle magazine.
Figure 3:
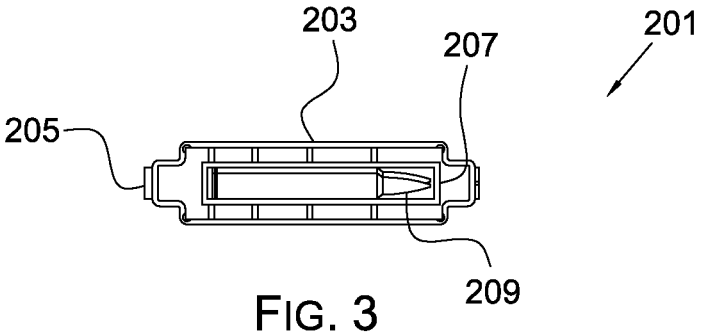
FIG. 3 is a top view of the loader apparatus of FIG. 2.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional ammunition systems. Specifically, the apparatus of the present application allows for quickly and effectively loading a magazine with a plurality of cartridges previously stored in the loader apparatus. In addition, the apparatus is used to package and ship the cartridges eliminating the wasted packaging. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
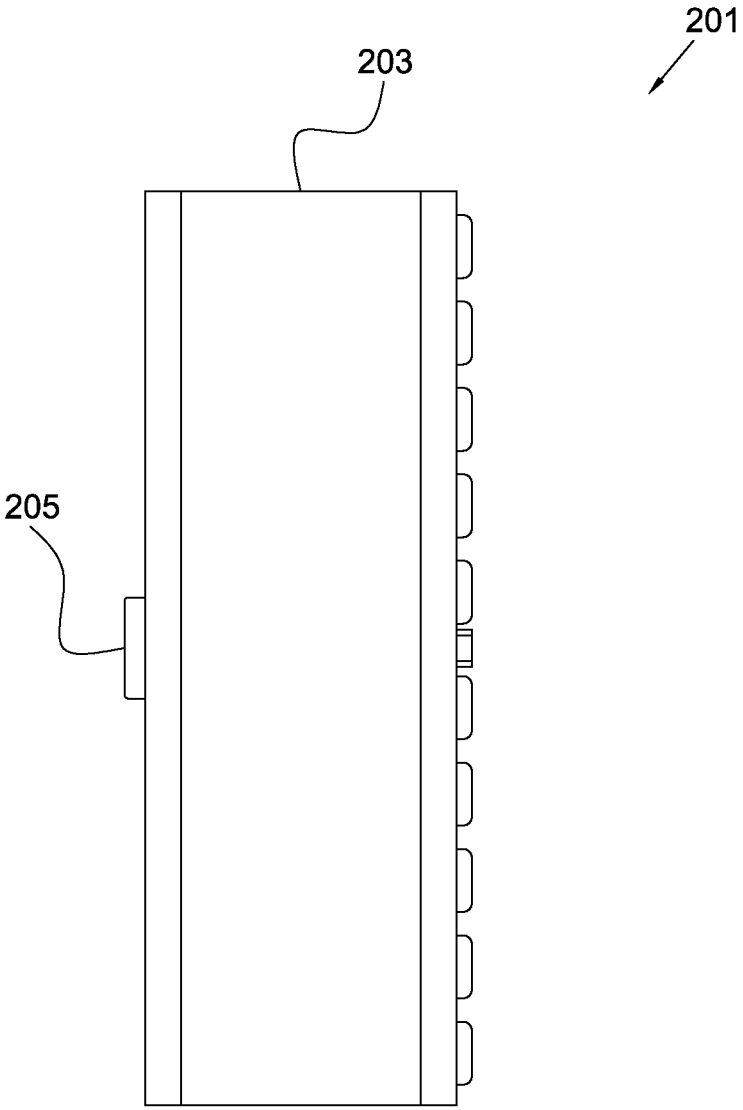
FIG. 2 is a side view of a rifle magazine loader apparatus in accordance with a preferred embodiment of the present application.

Referring now to the drawings wherein like reference characters identify corresponding or similar elements throughout the several views, FIG. 2 depicts a side view of a loader apparatus 201 in accordance with a preferred embodiment of the present application. It will be appreciated that apparatus 201 overcomes one or more of the above-listed problems commonly associated with conventional speed loader devices.

In the contemplated embodiment, apparatus 201 includes an elongated body 203 configured to hold a plurality of cartridges 209 therein, as well as being configured to aid in the loading of the cartridges 209 into a magazine. Apparatus 201 further includes a pin 205 configured to engage with an inside of body 203 to hold body 203 and a slider device 211 together. It should be appreciated that pin 205 can vary in form, and in some embodiments, may not be required to hold apparatus 201 together.

Figure 4:
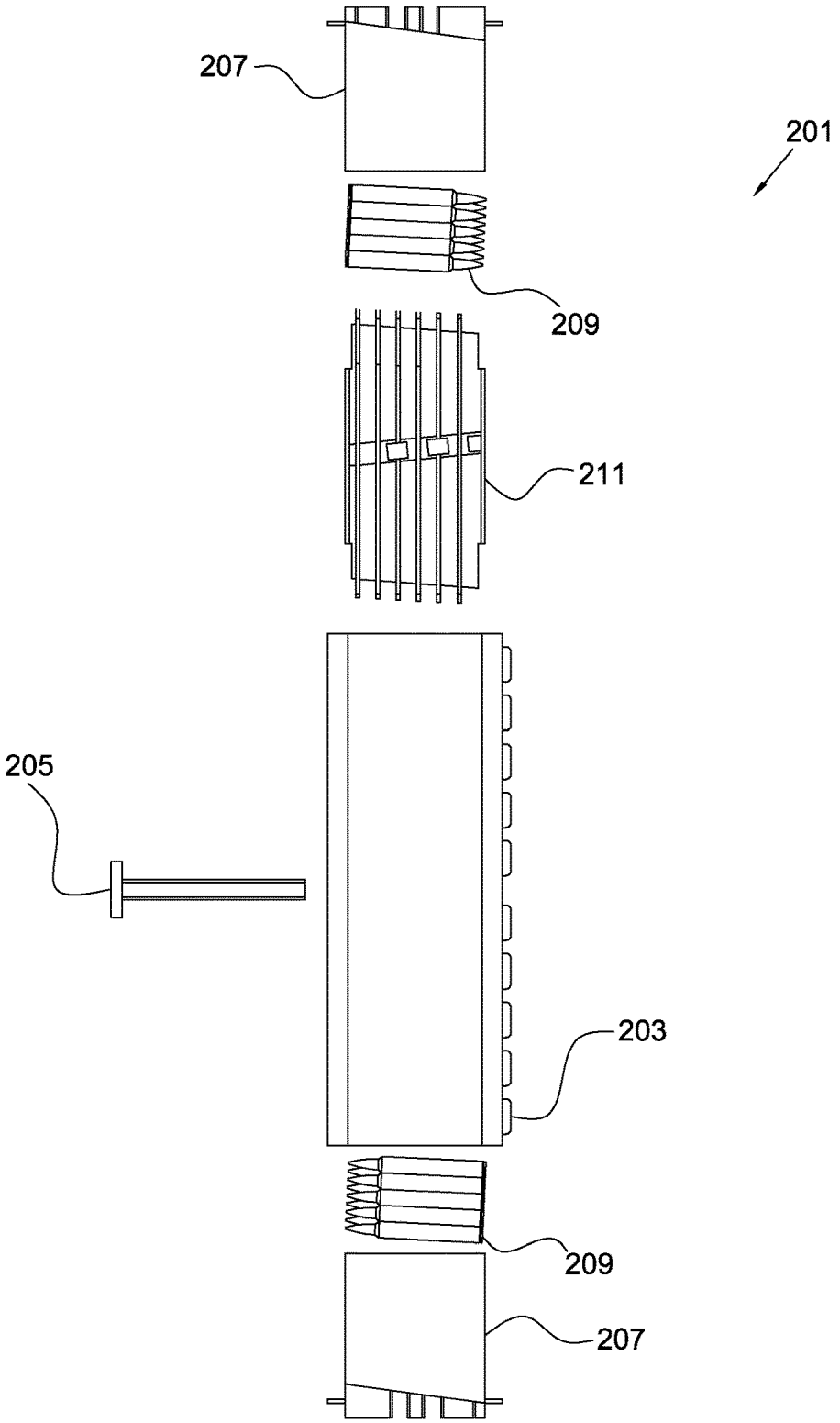
FIG. 4 is an exploded view of the loader apparatus of FIG. 2.
Figure 5:
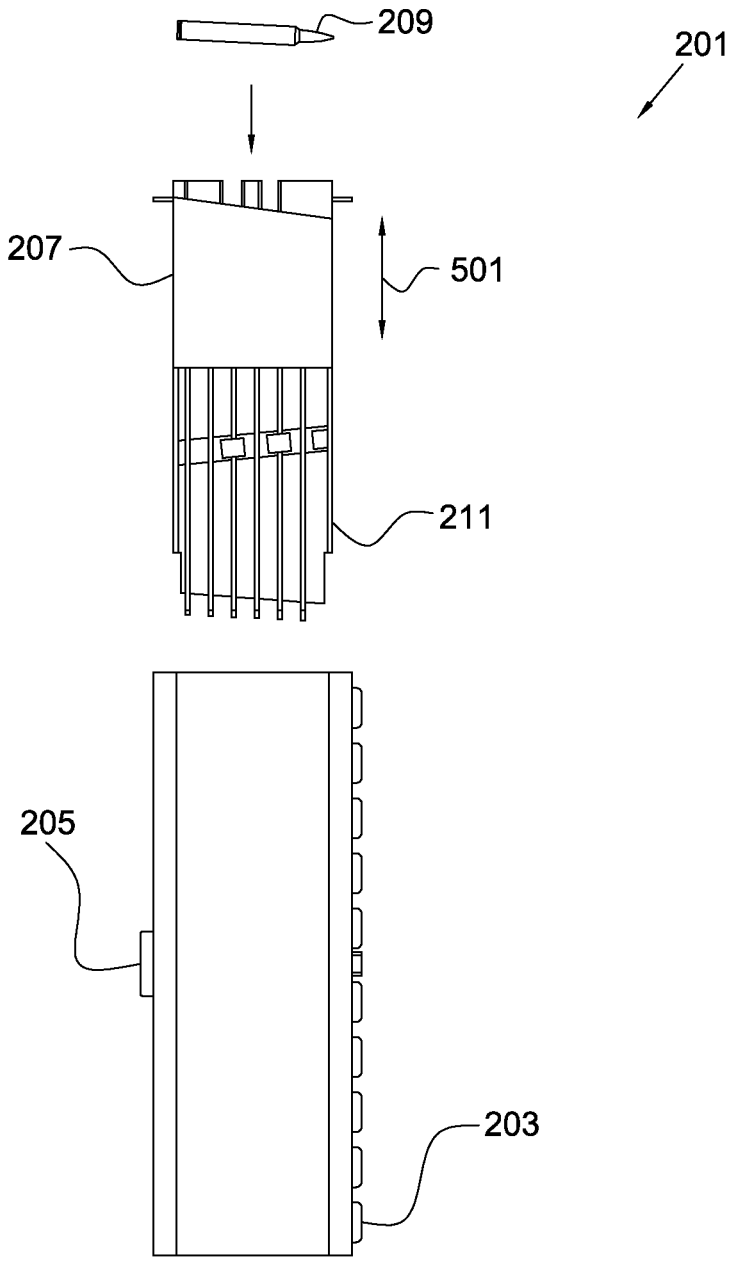
FIG. 5 is a side view showing sliding movement of a cradle of FIG. 2.

As shown in FIGS. 4 and 5, body 203 houses a slider device 211, wherein slider device 211 slidingly engages with one or more cradles 207 configured to hold a plurality of cartridges. In the preferred embodiment, the device 211 has a plurality of rails configured to facilitate sliding, however, it should be appreciated that alternative embodiments could achieve sliding via various means.

The plurality of cartridges 209 come secured within a corresponding cradle 207 (as shown in FIG. 2). During use, the cradle 207 slides (as shown with arrow 501) relative to slider device 211, and thereby pushes the cartridges 209 out of the corresponding cradle.

Figure 6:
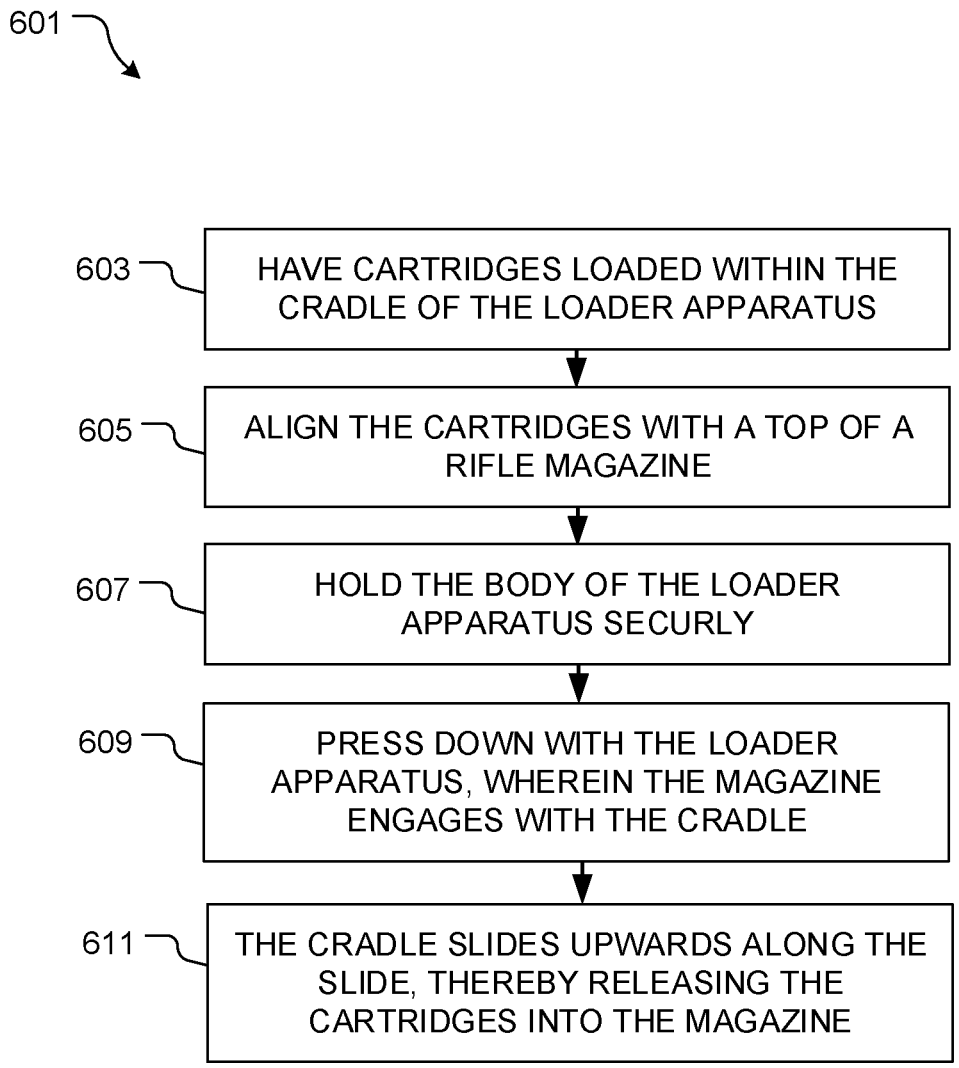
FIG. 6 is a flowchart of the preferred method of use of the loader apparatus of FIG. 2.

This method is further shown in FIG. 6, flowchart 601. The plurality of cartridges are pre-loaded within the loader apparatus, as shown with box 603. The cartridges rest within the cradle. The user then aligns a magazine, such as a rifle magazine, with the cartridges, wherein the opening to the magazine is positioned to receive the cartridges therein, as shown with box 605. The user then holds the loader apparatus securely, and pushes the loader apparatus down onto the magazine, wherein the magazine slides into the body of the loader apparatus, pushing the cradle upwards around the slider device, as shown with boxes 607, 609, 611. The plurality of cartridges are thereby released from the cradle into the magazine.

It should be appreciated that one of the unique features believed characteristic of the present invention is the configuration of the cradle with the slider device, thereby being configured to facilitate the transfer of the plurality of cartridges into the magazine.

As shown, in one embodiment, the loader apparatus 201 is double sided, thereby allowing for the user to first load a plurality of cartridges stored within the first side of body 203, and then rotate the apparatus 180 degrees, and then load the plurality of cartridges stored within the second side of body 203. This configuration is particularly beneficial for magazines having a curve, as is common in the art.

It should further be appreciated that apparatus 201 can be expanded or contracted to hold more or fewer cartridges. In addition, apparatus 201 can be adapted for various calibers.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A magazine loader apparatus, comprising:

an elongated body;

a slider device wholly and fixedly secured within an interior of the elongated body;

a first cradle configured to hold a plurality of cartridges within an inside of the first cradle, the plurality of cartridges positioned at a first end of the first cradle, the first cradle secured within the interior of the elongated body such that the slider device extends into the inside of the first cradle from a second end of the first cradle;

wherein the plurality of cartridges are configured to align with a firearm magazine such that the firearm magazine engages with the first cradle;

wherein applying force to the first cradle via the firearm magazine causes the first cradle to slidingly engage with the slider device and slide away from the magazine, thereby releasing the plurality of cartridges into the magazine; and a second cradle secured within the interior of the elongated body opposite the first cradle, the second cradle configured to hold a second plurality of cartridges.

2. The apparatus of claim 1, further comprising:

a pin configured to extend through the elongated body and secure the slider device within the elongated body.

3. A method of loading cartridges in a firearm magazine comprising:

providing the magazine loader apparatus of claim 1;

having the plurality of cartridges loaded in the first cradle;

aligning the plurality cartridges with a top of the firearm magazine; and applying force to the first cradle via the firearm magazine such that the first cradle slidingly engages with the slider device, wherein the firearm magazine slides within the elongated body and the plurality of cartridges are released into the firearm magazine.

* * * * *